US009328710B2

(12) United States Patent
Krauss et al.

(10) Patent No.: US 9,328,710 B2
(45) Date of Patent: May 3, 2016

(54) FUEL DELIVERY DEVICE

(75) Inventors: Jost Krauss, Gerlingen (DE); Guenter Veit, Plochingen (DE); Andreas Sommerer, Kernen (DE); Steffen Meyer-Salfeld, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 454 days.

(21) Appl. No.: 13/808,959

(22) PCT Filed: Jun. 9, 2011

(86) PCT No.: PCT/EP2011/059556

§ 371 (c)(1),
(2), (4) Date: Jan. 8, 2013

(87) PCT Pub. No.: WO2012/010373

PCT Pub. Date: Jan. 26, 2012

(65) Prior Publication Data

US 2013/0112174 A1 May 9, 2013

(30) Foreign Application Priority Data

Jul. 21, 2010 (DE) ..... 10 2010 031 622

(51) Int. Cl.
*F02M 69/02* (2006.01)
*F02M 63/02* (2006.01)
(Continued)

(52) U.S. Cl.
CPC ..... *F02M 69/02* (2013.01); *F02M 63/025* (2013.01); *F04C 2/3442* (2013.01); *F04C 11/00* (2013.01); *F04C 14/02* (2013.01); *F04C 14/26* (2013.01); *F02M 37/00* (2013.01); *F04C 14/22* (2013.01)

(58) Field of Classification Search
CPC ..... F02M 69/00; F02M 69/002; F02M 69/02; F02M 59/20; F02M 59/24–59/30; F02M 37/04–37/06; F04C 11/00
USPC ..... 123/495, 496, 504, 506, 510, 511, 514; 701/104
See application file for complete search history.

(56) References Cited

U.S. PATENT DOCUMENTS 2,266,191 A * 12/1941 Granberg ..... 418/29
4,711,616 A * 12/1987 Tsukahara et al. ..... 417/216
(Continued)

FOREIGN PATENT DOCUMENTS

DE 10002132 8/2001
DE 10102531 7/2002
(Continued)

OTHER PUBLICATIONS

International Search Report for Application No. PCT/EP2011/059556 dated Aug. 30, 2011 (English Translation and Original, 6 pages).

*Primary Examiner* — Lindsay Low
*Assistant Examiner* — Robert Werner
(74) *Attorney, Agent, or Firm* — Michael Best & Friedrich LLP

(57) ABSTRACT

The invention proposes a fuel delivery device for a fuel injection device of an internal combustion engine, having a delivery pump (10) and having at least one high-pressure pump (16). By means of the delivery pump (10), fuel from a storage container (12) is delivered to the suction side of the high-pressure pump (16), and fuel is delivered into a high-pressure region (18) by the high-pressure pump (16). The delivery pump (10) has an adjustable displacement volume, which means that a variable quantity of fuel can be conveyed at the same rotational speed.

19 Claims, 5 Drawing Sheets

(51) Int. Cl.

| | |
|---|---|
| ***F04C 2/344*** | (2006.01) |
| ***F04C 11/00*** | (2006.01) |
| ***F04C 14/02*** | (2006.01) |
| ***F04C 14/26*** | (2006.01) |
| *F02M 37/00* | (2006.01) |
| *F04C 14/22* | (2006.01) |

(56) References Cited

U.S. PATENT DOCUMENTS

| | | | | |
|---|---|---|---|---|
| 5,141,418 | A * | 8/1992 | Ohtaki et al. | 418/26 |
| 5,941,214 | A | 8/1999 | Hoffmann et al. | |
| 6,102,001 | A * | 8/2000 | McLevige | 123/387 |
| 6,293,253 | B1 * | 9/2001 | Arnold et al. | 123/458 |
| 6,367,454 | B1 * | 4/2002 | Rembold et al. | 123/497 |
| 6,537,038 | B2 * | 3/2003 | Bodzak | 417/213 |
| 6,609,500 | B2 * | 8/2003 | Ricco et al. | 123/446 |
| 7,219,654 | B2 | 5/2007 | Ludwig et al. | |
| 7,491,043 | B2 * | 2/2009 | Clements et al. | 418/30 |
| 7,640,916 | B2 * | 1/2010 | Ulrey et al. | 123/446 |
| 8,192,172 | B2 * | 6/2012 | Baker et al. | 417/43 |
| 8,312,862 | B2 | 11/2012 | Klesse et al. | |

FOREIGN PATENT DOCUMENTS

| | | |
|---|---|---|
| DE | 10343482 A1 | 4/2005 |
| GB | 2327778 | 2/1999 |

* cited by examiner

FUEL DELIVERY DEVICE

BACKGROUND OF THE INVENTION

The invention relates to a fuel delivery device for a fuel injection of an internal combustion engine.

Such a fuel delivery device and the working principle thereof has already been disclosed by the series of publications on a diesel common rail injection system (ISBN-978-3-86522-010-3) of Robert Bosch GmbH or EP 1 195 514 A2. This fuel delivery device comprises an electrically driven supply pump, which delivers fuel to the suction side of a high-pressure pump. The high-pressure pump delivers fuel into a high-pressure region, from which at least one injector of the fuel injection device is supplied at least indirectly with fuel. An electrical control device is provided, which via a sensor device receives a signal for the pressure prevailing in the high-pressure region. The electrical control device serves for variable activation of the electrical drive of the supply pump, so that the fuel delivery quantity of the supply pump can be varied through variation of the rotational speed. This allows a fuel delivery quantity of the supply pump to be adjusted to the operating conditions but the pump has a high drive power demand and requires electrical control and sensor devices.

SUMMARY OF THE INVENTION

The fuel delivery device according to the invention has the advantage that the supply pump has a variable displacement, so that a variable quantity of fuel can be delivered at a constant rotational speed. The facility for varying the fuel delivery quantity at a constant rotational speed makes it possible to eliminate the feedback control of the fuel delivery quantity via the electrical drive and to dispense with the control and sensor devices, thereby saving costs. The supply pump may be mechanically or electrically driven and is capable of varying its fuel delivery quantity at a constant rotational speed.

In a first advantageous embodiment of the fuel delivery device the supply pump delivers a variable quantity of fuel, which varies between a zero delivery quantity and a maximum quantity. The maximum quantity is determined by the maximum displacement of the supply pump. The wide range within which the fuel delivery quantity can vary allows an optimum adjustment of the fuel delivery quantity to the fuel demand in the high-pressure region. Additional components, such as the electrical drive of the supply pump, for example, an electrical control device for feedback control of the electrical drive or a metering unit (ZME), which adjusts the fuel delivery quantity to the demand of the high-pressure pump, are eliminated.

In an advantageous development of the method the adjustable displacement is regulated via a control pressure. No further external control devices need to be involved in order to adjust the fuel delivery quantity of the supply pump to the demand in the high-pressure region. Sensor units for registering the pressure are also eliminated, since the pressure does not have to be determined, but instead directly influences the delivery quantity. This reduces the cost outlay and simplifies the construction of the low-pressure circuit.

In a further advantageous development the control pressure is the fuel pressure on the delivery side of the supply pump. In this case the supply pump adjusts optimally to the fuel demand in the high-pressure region. No further components such as an overflow valve and metering unit need to be used. Since the quantity of fuel required by the high-pressure pump is always delivered by the supply pump and any excess fuel delivered does not have to be diverted, the fuel consumption is reduced.

A particular advantage accrues if the control pressure is the fuel pressure between a fuel filter fitted on the delivery side and the suction side of the high-pressure pump. The supply pump adjusts the pressure on the suction side of the high-pressure pump irrespective of the pressure loss of the fuel filter. Influencing variables such as the charge state of the fuel filter or temperature-induced obstruction of the fuel filter are compensated for.

A further advantage accrues if the control pressure is the fuel pressure in the return to the fuel tank. With this solution, too, the use of further components is reduced, since the metering unit can be dispensed with. The excess fuel delivered serves as control pressure, so that a different design of the supply pump control elements is possible.

Depending on the design, the fuel is diverted into the return to the fuel tank by an overflow valve on the suction side of the high-pressure pump, or the fuel is diverted into the return to the fuel tank by a pressure regulator in the high-pressure region.

A particular advantage accrues if the control pressure is the fuel pressure in the high-pressure accumulator. This results in a feedback loop which adjusts the pressure in the high-pressure accumulator without electrical registering of actual values, without electrical signal processing and without electrical control elements. It is furthermore possible to dispense with the pressure regulator on the high-pressure accumulator.

A further advantage accrues if the adjustable displacement is regulated via a regulating pressure. The regulating pressure is varied by an electrical control device and a pressure regulator. This affords scope for varying the delivery characteristic and hence monitored influencing of the fuel delivery quantity of the supply pump. The regulating pressure setting for varying the displacement can be varied according to the engine operating point or as a function of the pressure in the high-pressure accumulator.

The use of a vane cell pump or an external gear pump or a roller cell pump or an internal gear pump or a pendulum-slider pump as supply pump with adjustable delivery is advantageous, since it is possible to resort to known types of pump and the development effort is reduced.

BRIEF DESCRIPTION OF THE DRAWINGS

Preferred exemplary embodiments of the invention are represented in the drawing and are explained in more detail in the following description.

In the drawing.

DETAILED DESCRIPTION

Figure 1:
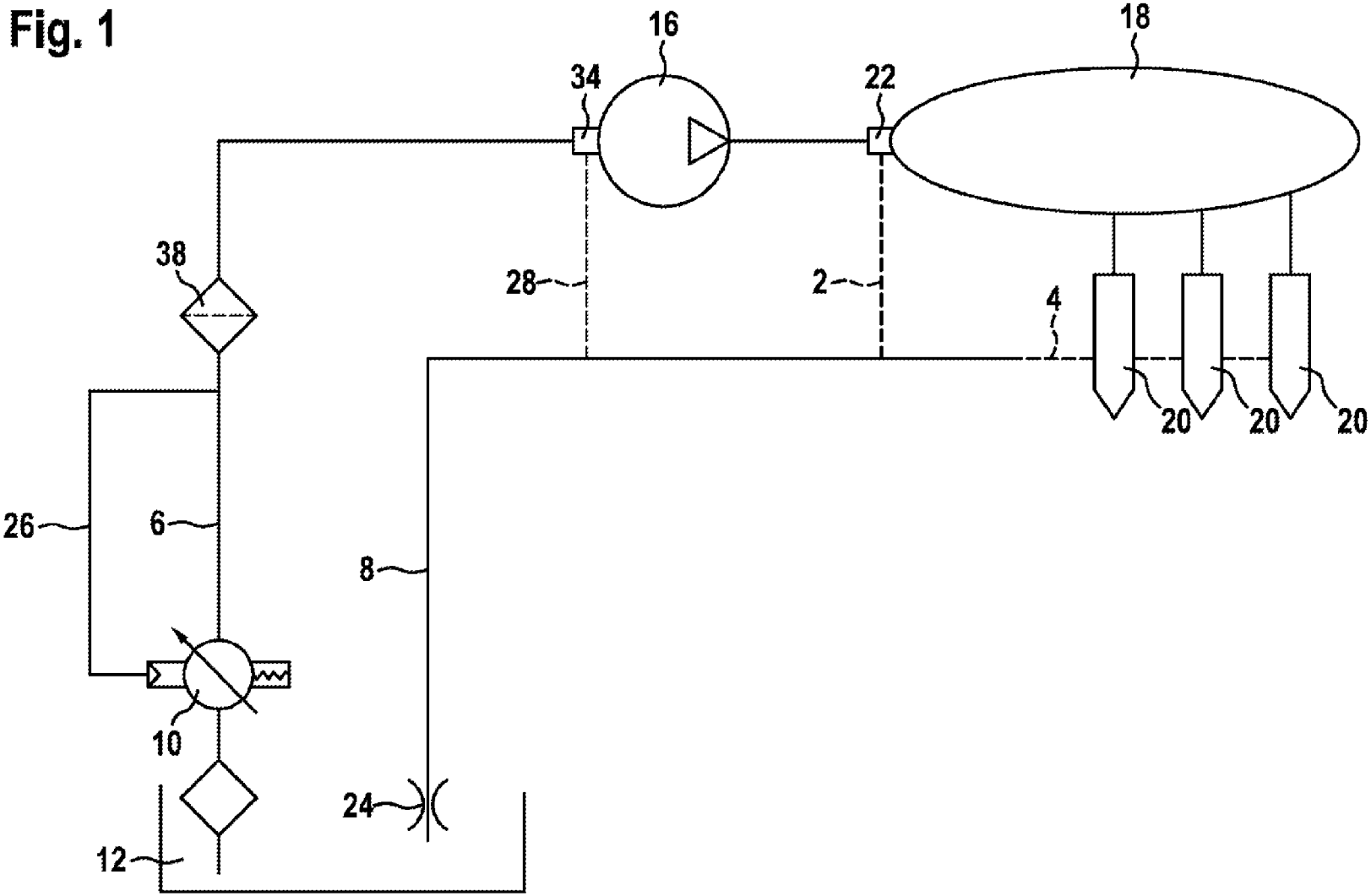
FIG. 1 shows a schematic representation of a fuel delivery device according to a first exemplary embodiment of the invention.

FIG. 1 shows a schematic representation of a fuel delivery device according to a first exemplary embodiment of the invention. The fuel delivery device comprises a supply pump 10, which sucks in fuel from a fuel tank 12. The supply pump 10 serves to deliver fuel to the suction side of at least one high-pressure pump 16, which is likewise an integral part of the fuel delivery device. The supply pump 10 may be mechanically driven by the engine or the high-pressure pump via a coupling, gearwheel or toothed belt. Alternatively the supply pump 10 may comprise an electrical drive, which can be operated with a variable output and hence a variable rotational speed or with a constant output and rotational speed.

At least the one high-pressure pump 16 serves to deliver fuel into a high-pressure region 18 of the fuel delivery device, which comprises a high-pressure accumulator 18, for example. From the high-pressure region 18 one or more injectors 20 are supplied with fuel, an injector 20 being assigned to each cylinder of the internal combustion engine.

The supply pump 10 may be arranged on the high-pressure pump 16, or it may be integrated into the latter or arranged remotely from the high-pressure pump 16, for example in the fuel tank 12 or in a hydraulic line between the fuel tank 12 and the high-pressure pump 16. The high-pressure pump 16 comprises at least one pump element, which in turn comprises a pump piston, which is driven in a reciprocating movement. The high-pressure pump 16 may comprise its own drive shaft, which via a cam or eccentric generates the reciprocating movement of the pump piston. The drive shaft of the high-pressure pump 16 is mechanically driven by the internal combustion engine, for example via a transmission or a belt drive, so that the rotational speed of the high-pressure pump 16 is proportional to the rotational speed of the internal combustion engine. Alternatively the high-pressure pump 16 may not have a drive shaft of its own and the reciprocating movement of the pump piston is generated by an eccentric or cam of a shaft of the internal combustion engine. In this case multiple high-pressure pumps 16 may be provided. Alternatively a hydraulic actuation may also be provided.

The supply pump 10 may be arranged remotely from at least the one high-pressure pump 16, for example also in the fuel tank 12. The supply pump 10 here is connected via a hydraulic line 6 to the suction side of at least the one high-pressure pump 16. A fuel filter 38 may be arranged in the hydraulic line in order to prevent dirt particles getting into the high-pressure pump 16 and into the high-pressure region 18.

A pressure regulator 22, which monitors the pressure prevailing in the high-pressure region 18, may be provided in the high-pressure region 18. If the pressure in the high-pressure region 18 is too high, the pressure regulator 22 allows excess fuel to pass via the hydraulic line 2 into the return 8 to the fuel tank 12. A required pressure can thereby be set in the high-pressure region 18 as a function of operating parameters of the internal combustion engine.

Excess fuel from the drive region of the high-pressure pump 16 can be led via the hydraulic line 28 to the return 8 and thereby to the fuel tank 12. If the supply pump 10 delivers more fuel to the suction side of the high-pressure pump 16 than is needed, excess fuel can be led through an overflow valve 34 on the high-pressure pump 16 via the hydraulic line 28 to the return 8 and thereby to the fuel tank 12.

In addition, a fuel return of the injectors 20 can be led via the hydraulic line 4 to the return 8 and thereby to the fuel tank 12.

Figure 2:
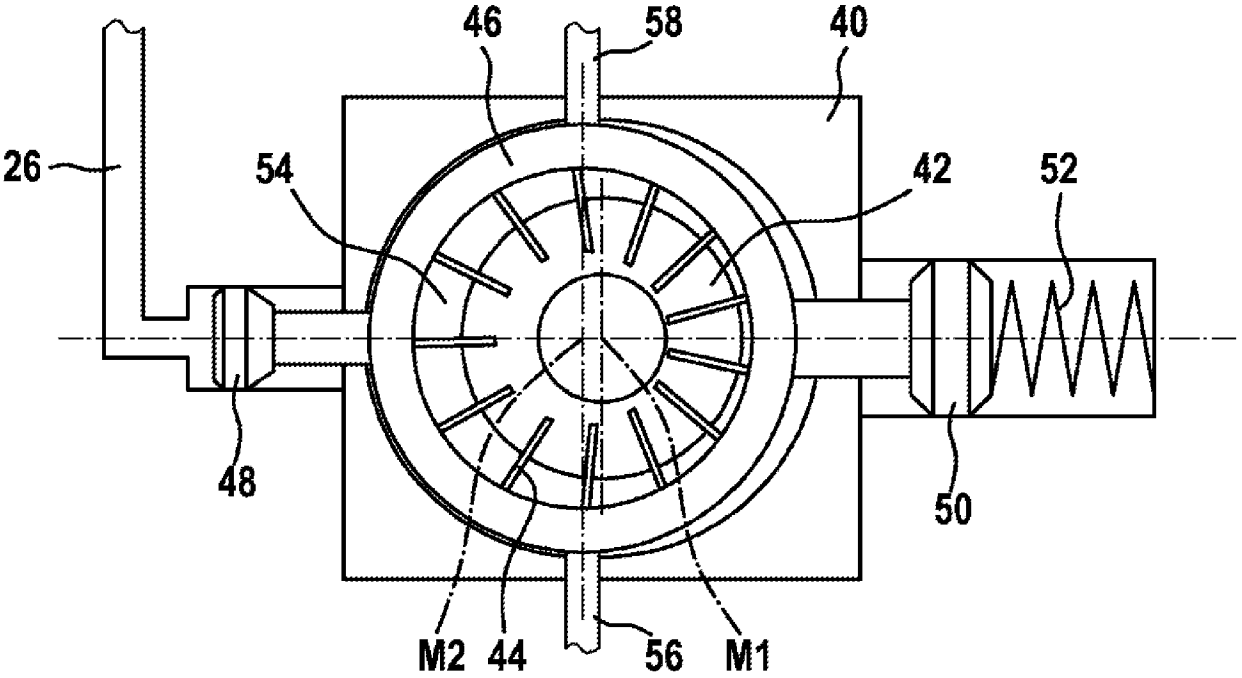
FIG. 2 shows a schematic representation of a pump having an adjustable displacement for a fuel delivery device.

FIG. 2, by way of example in a schematic sectional representation, shows a pump with adjustable displacement for a fuel delivery device. It comprises a housing 40, in which a rotor 42 having at least one or more vanes 44 is situated. The rotor 42 rotates about an axis which runs perpendicular to the page through a center point M1.

A circular stator ring 46 is held by a first control piston 48 and a second control piston 50. The two control pistons are arranged opposite one another. A further point of support of the stator ring 46 may also formed by a height adjustment screw (not shown). The axis of the circular stator ring 46 runs through a center point M2. A control pressure impinges on the rear side of the first control piston 48 via a hydraulic line 26. In the exemplary embodiment described the control pressure is provided by a fuel pressure inside the fuel delivery device. The second control piston 50 acts in opposition to the first control piston 48 and is held in a specific position by a spring 52. The control pressure and the spring force mean that two forces act on the stator ring 46 in opposite directions.

The electrically or mechanically driven rotor 42 rotates inside the stator ring 46 and the vanes 44 guided in the rotor are pressed against the stator ring 46 by centrifugal forces. The cells 54 required for transporting the fuel become increasingly larger due to the rotation of the rotor 42 and in so doing fill with fuel via a suction port 56, which sucks fuel out of the fuel tank 12. On attaining the largest cell volume, the cells 54 are separated from the suction side and under further rotation are connected to the delivery side. Under a further rotation the cells 54 are constricted and force liquid via the delivery port 58 into a hydraulic line, which leads to the suction side of the high-pressure pump 16.

The stator ring 46 is displaced in the housing as a function of the force resulting from the fuel pressure acting on the first control piston 48 and the force which the spring 52 exerts on the second control piston 50. If the two forces are of equal magnitude, the stator ring is situated in the middle position and the two center points M1 and M2 coincide. In this case the fuel delivery quantity returns to a zero delivery quantity, that is to say the delivery quantity is zero.

If the fuel pressure diminishes, so that the force exerted by the spring 52 is greater than the force resulting from the fuel pressure acting on the first control piston 48, the spring 52 displaces the stator ring 46 into an eccentric position in which the center points M1 and M2 no longer coincide. Since the suction side and the delivery side are separated from one another, the supply pump 10 again displaces fuel. The displacement of the pump increases as the distance between the center points M1 and M2 increases.

The supply pump 10 can be operated at a constant rotational speed or a variable rotational speed by a mechanical or electrical drive. The rotational speed of the supply pump 10 influences the quantity of fuel delivered. By regulating the control pressure a variable quantity of fuel can be delivered at a constant rotational speed.

One example of a supply pump 10 having a variable displacement is the "variable vane cell pump, type PV7" from Bosch Rexroth, which in its construction is identical to the supply pump 10 described, but which would have to be modified to suit the dimensions and requirements of a fuel delivery device.

Alternatively an external gear pump or a roller cell pump or an internal gear pump or a pendulum-slider pump can be used as supply pump 10 with variable displacement. An example of a pendulum-slider pump having an adjustable delivery is shown in the published patent application DE 101 02 531 A1.

In the exemplary embodiment according to FIG. 1 the control pressure is the fuel pressure on the delivery side 6 of the supply pump 10. The control pressure acts on the first control piston 48 via a hydraulic line 26 and thereby influences the displacement of the supply pump 10. If a delivery-side fuel filter 38 is provided, the pressure on the suction side of the high-pressure pump 16 between the fuel filter 38 and the high-pressure pump 16 may alternatively serve as control pressure.

If a change in the operating conditions briefly causes the supply pump 10 to deliver more fuel to the high-pressure pump 16 than is needed, an increased pressure builds up in the hydraulic line 6. The pressure in the hydraulic line 6 rises as a function of the excess quantity of fuel delivered. The rise in pressure causes the control pressure acting on the first control piston 48 to increase, the displacement of the supply pump 10 is reduced and the fuel delivery quantity is thereby reduced. The fuel quantity of the supply pump 10 is adjusted to the demand of the high pressure pump 16. If the fuel pressure in the hydraulic line 6 falls, because the high-pressure pump 16 has an increased fuel demand, the control pressure also falls and the supply pump 10 increases the fuel delivery quantity. The fuel delivery quantity of the supply pump 10 is adjusted to the demand of the high-pressure pump 16.

In order to simplify the low-pressure circuit, however, but with the same effect, the supply pump 10 may be adjusted to its own delivery pressure.

Figure 3:
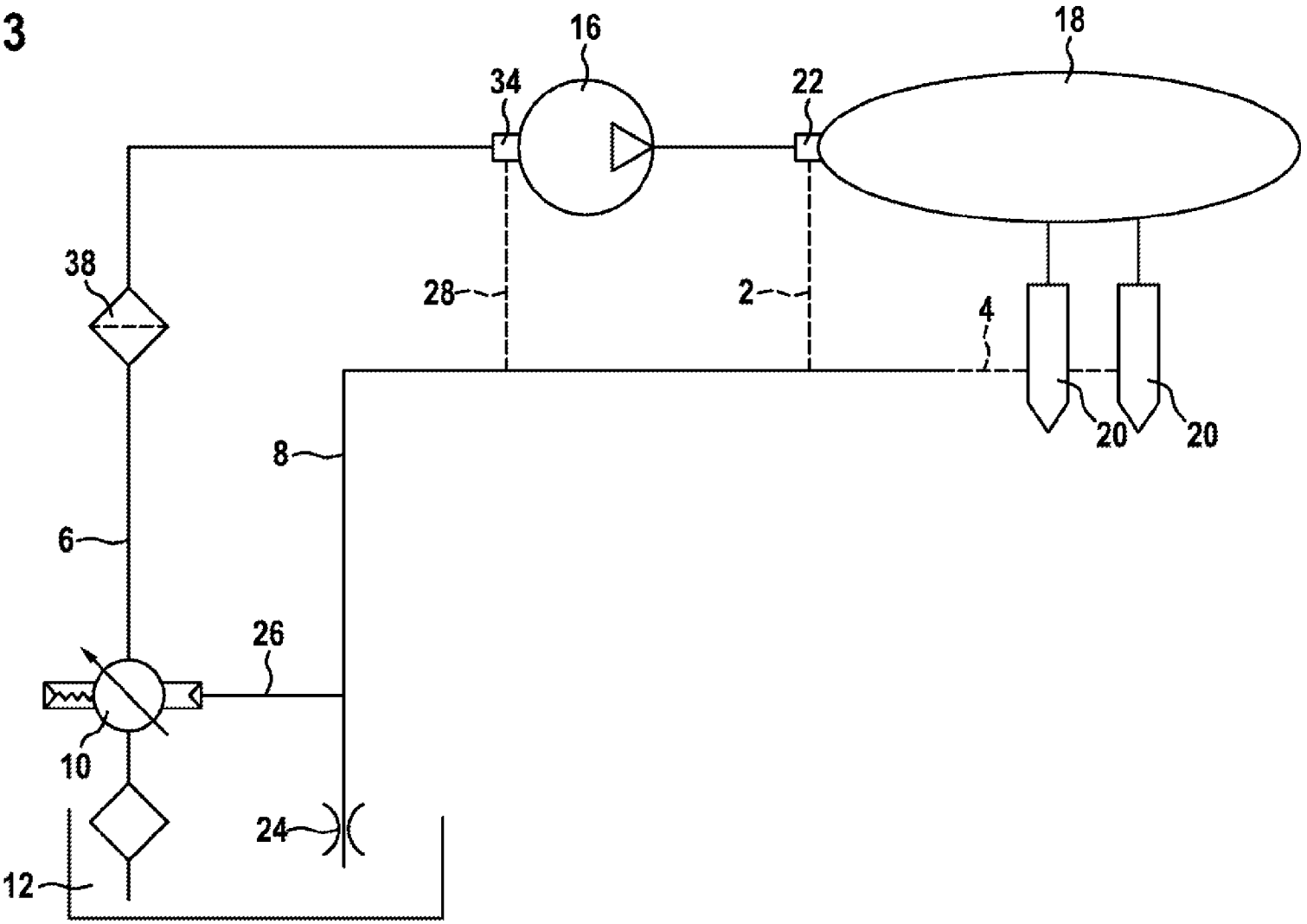
FIG. 3 shows a schematic representation of a fuel delivery device according to a second exemplary embodiment of the invention.

FIG. 3 shows a further embodiment of the invention. Here the control pressure is the fuel pressure in a return 8 to the fuel tank 12. A restrictor 24 causes a fuel pressure to build up in the return 8 to the fuel tank 12, which is connected either via the hydraulic line 26 or directly to the first control piston 48 of the supply pump 10. The restrictor 24 in the return 8 to the fuel tank 12 may be dispensed with if a backpressure is produced by a jet pump (not shown) in the return 8 to the fuel tank 12.

If a change in the operating conditions briefly causes the supply pump 10 to deliver more fuel to the high-pressure pump 16 than is needed, an overflow valve 34 diverts the excess fuel to the return 8 via the hydraulic line 28. The pressure in the return 8 rises as a function of the excess quantity of fuel delivered. The rise in pressure in the return 8 causes the control pressure acting on the first control piston 48 to increase, the displacement of the supply pump 10 is reduced and the fuel delivery quantity is thereby reduced. If only a little fuel is diverted into the return 8 by the overflow valve 34, the control pressure falls and the supply pump 10 increases the fuel delivery quantity. The fuel delivery quantity of the supply pump 10 is adjusted to the fuel demand of the high-pressure pump 16.

Alternatively the fuel may be diverted into the return 8 to the fuel tank 12 by the pressure regulator 22 in the high-pressure region 18. The pressure regulator 22 here may be situated directly on the high-pressure accumulator 18 or on the high-pressure pump 16 or between the high-pressure pump 16 and the high-pressure accumulator 18. The pressure regulator 22 here is regulated by an electrical control unit. If a higher pressure than is needed prevails in the high-pressure region 18, excess fuel is diverted by the pressure regulator 22. The pressure in the return 8 rises as a function of the quantity of fuel diverted. The increased fuel return causes the pressure in the return 8 to increase upstream of the restrictor 24 and the control pressure acting on the first control piston 48 rises. The displacement of the supply pump 10 is reduced, thereby reducing the fuel delivery quantity. If only a little fuel is diverted into the return 8 by the regulator 22, the control pressure falls and the supply pump 10 increases the fuel delivery quantity.

Figure 4:
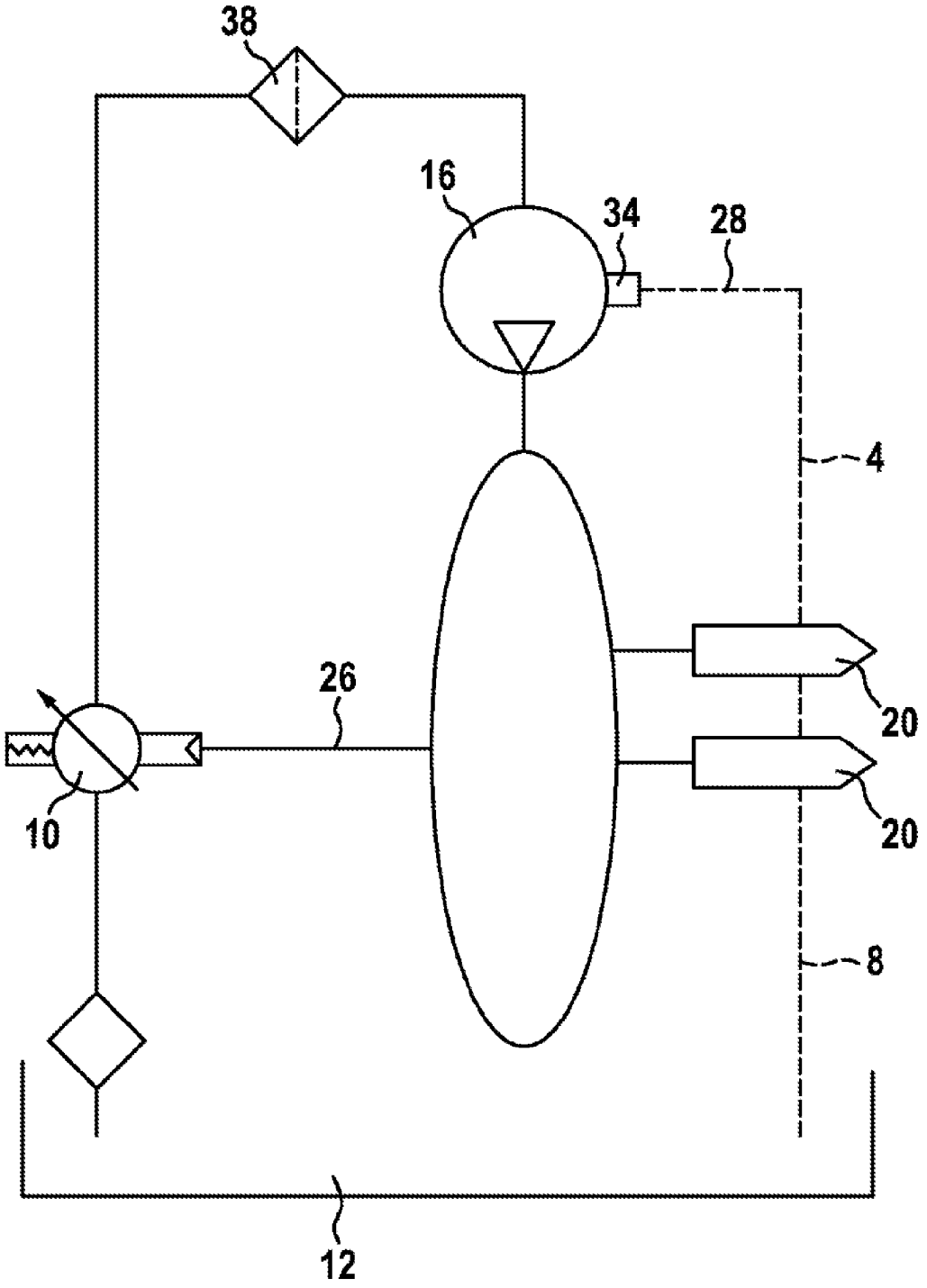
FIG. 4 shows a schematic representation of a fuel delivery device according to a third exemplary embodiment of the invention.

FIG. 4 shows a further embodiment of the invention. Here the control pressure is the fuel pressure in the high-pressure accumulator 18. Through the hydraulic line 26 the pressure in the high-pressure region 18 acts directly on the first control piston 48 of the supply pump 10 and consequently influences the displacement of the supply pump 10. If an excess pressure prevails in the high-pressure accumulator 18, the fuel delivery quantity of the supply pump 10 is reduced, if the pressure in the high-pressure accumulator 18 is too low, the fuel delivery quantity of the supply pump 10 is increased, otherwise it remains constant.

In all the embodiments of the invention shown a regulating pressure can be allowed to impinge on the rear side of the second control piston 50 for monitored influencing of the displacement. A force, which is composed of the force of the spring 52 and the regulating pressure, thereby acts on the second control piston 50. The regulating pressure which acts on the second control piston 50 originates from any point of the fuel delivery device and should be lower than the control pressure which acts on the rear side of the first control piston 48.

Figure 5:
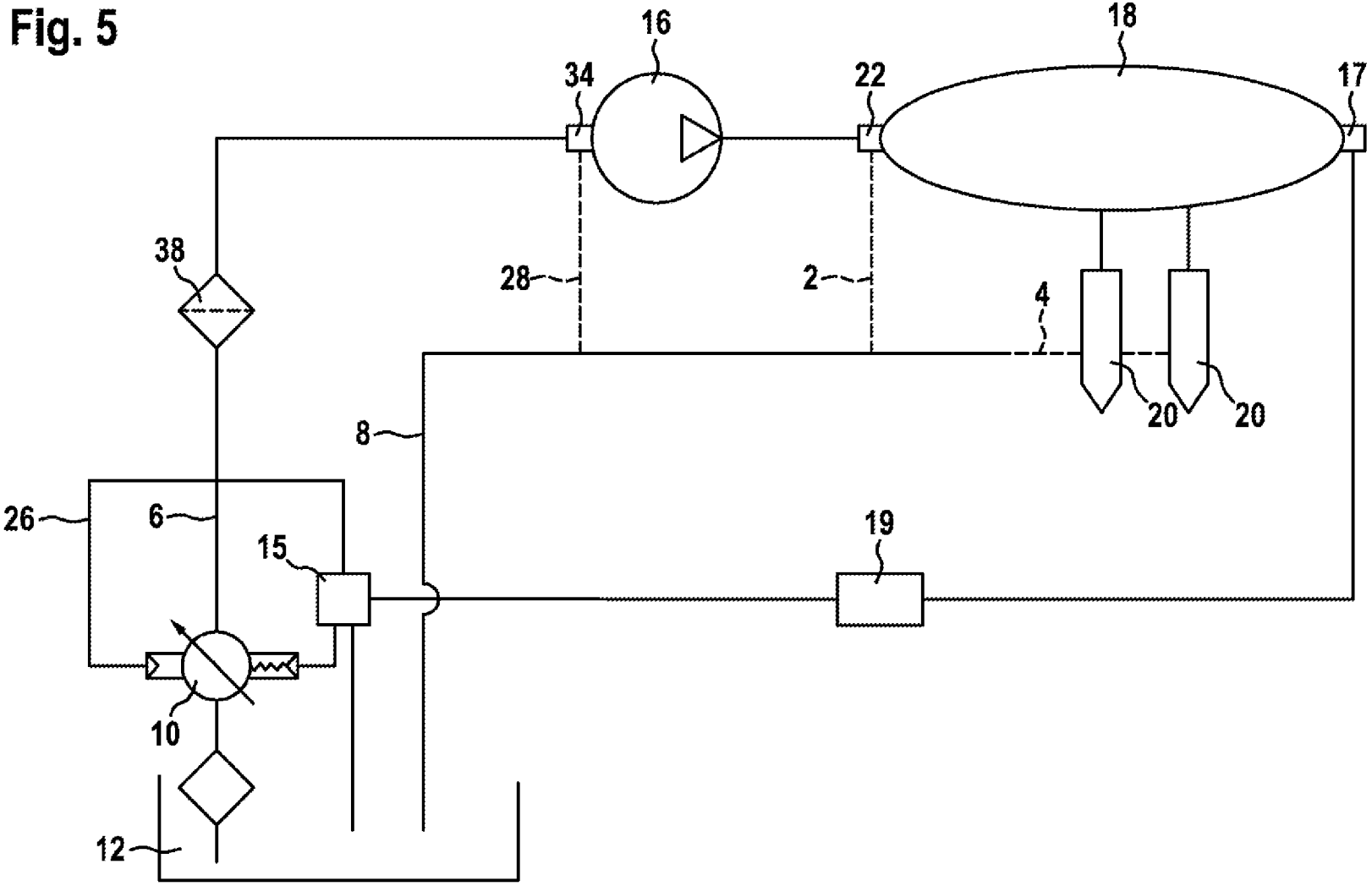
FIG. 5 shows a schematic representation of a fuel delivery device according to a fourth exemplary embodiment of the invention.

FIG. 5 shows a further embodiment of the invention. Here the regulating pressure is the fuel pressure on the delivery side of the supply pump 10. The regulating pressure is monitored by a pressure regulator 15, which is connected to an electronic control device 19. The electrical control device 19 is connected to a pressure sensor 17 in the high-pressure region 18, which supplies information on the pressure in the high-pressure region 18 to the electronic control device 19. The electrical control device 19 regulates the pressure regulator 15 as a function of the pressure in the high-pressure region 18 and via the regulating pressure consequently exercises a monitored influence on the delivery quantity of the supply pump 10. Unneeded fuel is diverted into the fuel tank 12 via a hydraulic line. The pressure regulator 15 allows a continuously variable adjustment of the force acting on the second control piston 50 of the supply pump 10. Varying the regulating pressure changes the delivery characteristic of the supply pump 10, resulting in different displacements of the supply pump 10 for the same control pressure.

What is claimed is:

1. A fuel delivery device for a fuel injection device of an internal combustion engine, having a supply pump (10) and at least one high-pressure pump (16), wherein the supply pump (10) delivers fuel from a fuel tank (12) to a suction side of the high-pressure pump (16) and the high-pressure pump (16) delivers fuel to a high-pressure region (18), characterized in that the supply pump (10) has a variable displacement, wherein the supply pump (10) has a constant speed of rotation such that the supply pump (10) is configured to deliver a variable quantity of fuel at the constant speed of rotation, wherein each of a hydraulic line (26), a suction port (56), and a delivery port (58) are coupled to the supply pump (10), the suction portion (56) configured to move fuel from the fuel tank (12) to the supply pump (10), the delivery port (58) configured to move fuel from the supply pump (10) to the high-pressure pump (16), and the hydraulic line (26) configured to provide a control pressure to the supply pump (10), wherein the hydraulic line (26) is a first hydraulic line, wherein the supply pump (10) is coupled to the high-pressure pump (16) via a second hydraulic line (6), and wherein one end of the first hydraulic line (26) is coupled directly to the second hydraulic line (6).

2. The fuel delivery device as claimed in claim 1, characterized in that the supply pump (10) delivers a variable quantity of fuel, which varies between a zero delivery quantity and a maximum quantity, the maximum quantity being given by a maximum displacement of the supply pump (10).

3. The fuel delivery device as claimed in claim 1, characterized in that the control pressure is a fuel pressure on a delivery side (6) of the supply pump (10).

4. The fuel delivery device as claimed in claim 1, characterized in that the control pressure is a fuel pressure between a fuel filter (38) and the suction side of the high-pressure pump (16).

5. The fuel delivery device as claimed in claim 1, characterized in that the variable displacement is additionally influenced by a regulating pressure.

6. The fuel delivery device as claimed in claim 5, characterized in that the regulating pressure is adjusted by a pressure regulator (15).

7. The fuel delivery device as claimed in claim 5, characterized in that the regulating pressure is adjusted as a function of at least one of an engine operating point and a pressure in the high-pressure region (18).

8. The fuel delivery device as claimed in claim 1, characterized in that the supply pump (10) is a variable vane cell pump, a variable external gear pump, a variable roller cell pump, a variable internal gear pump or a variable pendulum-slider pump.

9. The fuel delivery device as claimed in claim 6, characterized in that the regulating pressure is adjusted as a function of at least one of an engine operating point and a pressure in the high-pressure region (18).

10. The fuel delivery device as claimed in claim 1, wherein the supply pump (10) includes a first control piston (48) and a second control piston (50), and wherein the control pressure impinges upon the first control piston (48) to change the quantity of fuel exiting the supply pump (10) through the delivery port (58).

11. The fuel delivery device as claimed in claim 10, wherein a regulating pressure impinges upon the second control piston (50).

12. The fuel delivery device as claimed in claim 11, wherein the supply pump (10) further includes a spring (52) which also impinges upon the second control piston (50).

13. A fuel delivery device for a fuel injection device of an internal combustion engine, having a supply pump (10) and at least one high-pressure pump (16), wherein the supply pump (10) delivers fuel from a fuel tank (12) to a suction side of the high-pressure pump (16) and the high-pressure pump (16) delivers fuel to a high-pressure region (18), characterized in that the supply pump (10) has a variable displacement, wherein the supply pump (10) has a constant speed of rotation such that the supply pump (10) is configured to deliver a variable quantity of fuel at the constant speed of rotation, wherein each of a hydraulic line (26), a suction port (56), and a delivery port (58) are coupled to the supply pump (10), the suction portion (56) configured to move fuel from the fuel tank (12) to the supply pump (10), the delivery port (58) configured to move fuel from the supply pump (10) to the high-pressure pump (16), and the hydraulic line (26) configured to provide a control pressure to the supply pump (10), and wherein one end of the hydraulic line (26) is coupled directly to the high-pressure region (18).

14. The fuel delivery device of claim 13, wherein the supply pump (10) includes a first control piston (48) and a second control piston (50), and wherein the control pressure impinges upon the first control piston (48) to change the quantity of fuel exiting the supply pump (10) through the delivery port (58).

15. A fuel delivery device for a fuel injection device of an internal combustion engine, having a supply pump (10) and at least one high-pressure pump (16), wherein the supply pump (10) delivers fuel from a fuel tank (12) to a suction side of the high-pressure pump (16) and the high-pressure pump (16) delivers fuel to a high-pressure region (18), characterized in that the supply pump (10) has a variable displacement, wherein the supply pump (10) has a constant speed of rotation such that the supply pump (10) is configured to deliver a variable quantity of fuel at the constant speed of rotation, wherein each of a hydraulic line (26), a suction port (56), and a delivery port (58) are coupled to the supply pump (10), the suction portion (56) configured to move fuel from the fuel tank (12) to the supply pump (10), the delivery port (58) configured to move fuel from the supply pump (10) to the high-pressure pump (16), and the hydraulic line (26) configured to provide a control pressure to the supply pump (10), and wherein one end of the hydraulic line (26) is coupled directly to a pressure regulator (15).

16. The fuel delivery device of claim 15, wherein the supply pump (10) includes a first control piston (48) and a second control piston (50), and wherein the control pressure impinges upon the first control piston (48) to change the quantity of fuel exiting the supply pump (10) through the delivery port (58).

17. A fuel delivery device for a fuel injection device of an internal combustion engine, having a supply pump (10) and at least one high-pressure pump (16), wherein the supply pump (10) delivers fuel from a fuel tank (12) to a suction side of the high-pressure pump (16) and the high-pressure pump (16) delivers fuel to a high-pressure region (18), characterized in that the supply pump (10) has a variable displacement, wherein the supply pump (10) has a constant speed of rotation such that the supply pump (10) is configured to deliver a variable quantity of fuel at the constant speed of rotation, wherein each of a hydraulic line (26), a suction port (56), and a delivery port (58) are coupled to the supply pump (10), the suction portion (56) configured to move fuel from the fuel tank (12) to the supply pump (10), the delivery port (58) configured to move fuel from the supply pump (10) to the high-pressure pump (16), and the hydraulic line (26) configured to provide a control pressure to the supply pump (10), and wherein one end of the hydraulic line (26) is coupled directly to a return line (8) that extends from an injector (20) to the fuel tank (12).

18. The fuel delivery device as claimed in claim 17, wherein the fuel is diverted into the return line (8) and to the fuel tank (12) by an overflow valve (34) on the suction side of the high-pressure pump (16).

19. The fuel delivery device as claimed in claim 17, wherein the fuel is diverted into the return line (8) and to the fuel tank (12) by a pressure regulator (22) in the high-pressure region (18).

* * * * *